US005314129A

United States Patent [19]

Rivara

[11] Patent Number: 5,314,129

[45] Date of Patent: May 24, 1994

[54] COIL WINDER WITH SPINDLEHEAD MOVABLE IN A HORIZONTAL PLANE

[75] Inventor: Antonio Rivara, Basiglio, Italy

[73] Assignee: Tekma Kinomat S.r.l., Caronno Pertusella, Italy

[21] Appl. No.: 690,804

[22] Filed: Apr. 24, 1991

[51] Int. Cl.[5] ..... B21F 3/02

[52] U.S. Cl. ..... 242/7.09; 242/7.11

[58] Field of Search ..... 242/7.09, 7.14, 7.15, 242/7.16; 29/605

[56] References Cited

U.S. PATENT DOCUMENTS

| | | | |
|---|---|---|---|
| 3,228,615 | 1/1966 | Lancaster | 242/7.15 |
| 4,157,165 | 6/1979 | Bierman et al. | 242/7.14 |
| 4,173,312 | 11/1979 | Camardella | 242/7.11 |
| 4,558,835 | 12/1985 | Sunaoka | 242/7.14 |
| 4,635,865 | 1/1987 | Arnold | 242/7.14 |
| 4,722,486 | 2/1988 | Camardella | 242/7.09 |
| 4,725,017 | 2/1988 | Camardella | 242/7.09 |
| 4,809,917 | 3/1989 | Tsuchiya | 242/7.06 |
| 4,817,888 | 4/1989 | Arnold | 242/7.09 |
| 4,951,889 | 8/1990 | Camardella | 242/7.14 |

FOREIGN PATENT DOCUMENTS 0264578 4/1988 European Pat. Off. .

*Primary Examiner*—Katherine Matecki

*Attorney, Agent, or Firm*—Young & Thompson

[57] ABSTRACT

The invention concerns a coil winding machine and, more precisely, a coil winder to wind up coils for use in the electric and/or electronic field, of the type comprising a plurality of rotary spindles supporting the coil cores and a corresponding plurality of flyers feeding the wire to be wound up to the spindles. This coil winder also comprises mechanism to produce relative movements between each spindle and the respective flyer along the three cartesian axes (X, Y and Z), in order to carry out the winding of the coil and/or the twisting of the wire ends on the coil terminals. According to the invention, the spindles supporting the coil cores are mounted, rotating about their own axis (X), onto a support head which is in turn movable in a horizontal plane (axes X and Y), while the flyers are movable only along the third axis (Z).

3 Claims, 5 Drawing Sheets

COIL WINDER WITH SPINDLEHEAD MOVABLE IN A HORIZONTAL PLANE

BACKGROUND OF THE INVENTION

1. Field of the Invention

There is known at present a wide variety of coil winding machines, with even considerably different characteristics as far as working and productive capacity.

These include first of all coil winders with a revolving turret, an example of which is described in DE-PS-2.322.064 filed by the same Applicant. In a machine of this type, the coils are mounted on spindles radially projecting from a revolving turret and this latter has a rotary stepped motion, so that the single coils are moved forward through successive working stations, for example at least one loading station, a winding station and an unloading station, as well as one or more supplementary working or finishing stations. When the coils are unloaded, they are substantially finished and ready for use.

It is important to note, in order to fully understand the present invention, that in machines of this type the coil core is held stationary and the winding is carried out by a winding unit with rotary flyer, which is not only adapted to rotate about the coil core, performing at the same time an axial movement (X axis) to distribute the wire around said core, but also to perform transversal (Y axis) and vertical (Z axis) movements in order to carry out supplementary operations, as for example the twisting of a wire end around a coil terminal.

To perform the above movements, the rotary flyer is first of all mounted on a spindle revolving about the axis X and rotated by a motor of its own, the flyer unit being moreover mounted on slides adapted to perform said movements along the three axes X, Y, Z. Such movements are generally produced by numerically controlled D.C. motors, according to an increasingly developing technology.

Another type of coil winding machine is the so-called "on-line machine", wherein the coils are supported by a plurality of spindles with parallel axes, mounted on a bed and performing a simple high-speed rotary motion. With each spindle there cooperate corresponding flyers, adapted to perform the main wire distributing motion during coil winding, as well as a more complex motion for twisting for example the wire ends on the coil terminals, just before winding starts and after it has ended.

It is to be understood that, in this case, the rotary motion about the axis X is performed by the spindle carrying the actual coil core, while the flyer merely performs the movements along axes X, Y and Z, as specified heretofore.

2. Description of the Prior Art

Machines of this type are widely known, for example, from DE-A-2632671 and DE-A-3049406, as well as from IT-B-1.196.312 filed on Oct. 26, 1984, by the same Applicant. These machines are planned to wind up coils in a relatively simple way and with a high number of turns, at high production speeds.

A still further type of coil winding machine is the "bench machine", which can be for example of the type described in EP-A-182.177 filed by the same Applicant: in this machine, the coils are mounted on rotary spindles, while the wire is fed by flyers adapted to perform movements along the three axes X, Y and Z—similarly to what happens in the previously mentioned on-line machines—so that the operator merely has to carry out the loading and unloading of the coils.

A problem which is particularly felt in the aforecited machines—for example of IT-A-1.196.312 or of EP-A-182.177—actually concerns the automatic loading and unloading of the coils on the winding spindles. The known devices allowing to perform these operations are quite complicated, oversized and costly: they must in fact generally comprise gripper means moving at least along two axes, that is, at least along the X axis, so as to draw close to and away from the spindle supporting the coil, and at least along another axis—for example the Z or the Y axis, or a turnover axis perpendicular to the X axis—so as to replace a filled and finished coil by an empty coil core.

These known automatic loading and unloading devices, as well as being complicated and costly, are also difficult to mount—due to their large dimensions—onto a coil winder being used as a working station of a plurality of stations forming part of an automatic production line.

SUMMARY OF THE INVENTION

A first object of the present invention is therefore to realize a coil winder of the aforementioned general type, having improved working characteristics and wider possibilities of use.

Another object of the present invention is to realize a coil winder which is structurally conceived so as to make it particularly simple to automatically load and unload the coils.

A still further object of the invention is to propose a coil winder particularly suited to be used as a winding station forming part of an automatic production line.

According to the invention, these results are achieved with an automatic coil winder for use in the electric and/or electronic field—of the type comprising a plurality of rotary spindles supporting the coil cores, and a corresponding plurality of flyers feeding the wire to be wound on said spindles, means being moreover provided to produce relative movements between each spindle and the respective flyer along at least one axis (X) of the three cartesian axes (X, Y and Z), in order to carry out the winding of the coil and/or the twisting of the wire ends on the coil terminals—essentially due to the fact that the spindles supporting the coil cores are mounted both rotating about their own axes (X) and movable along said axis, and to the fact that it comprises means to control the rotary motion of the spindles, as well as first means to control their translatory motion along said axis (X).

BRIEF DESCRIPTION OF THE DRAWINGS

Further characteristics and advantages of the coil winder according to the present invention will anyhow be more evident from the following detailed description of some preferred embodiments thereof, given by way of example and illustrated on the accompanying drawings, in which.

DESCRIPTION OF THE PREFERRED EMBODIMENTS

Figure 1:
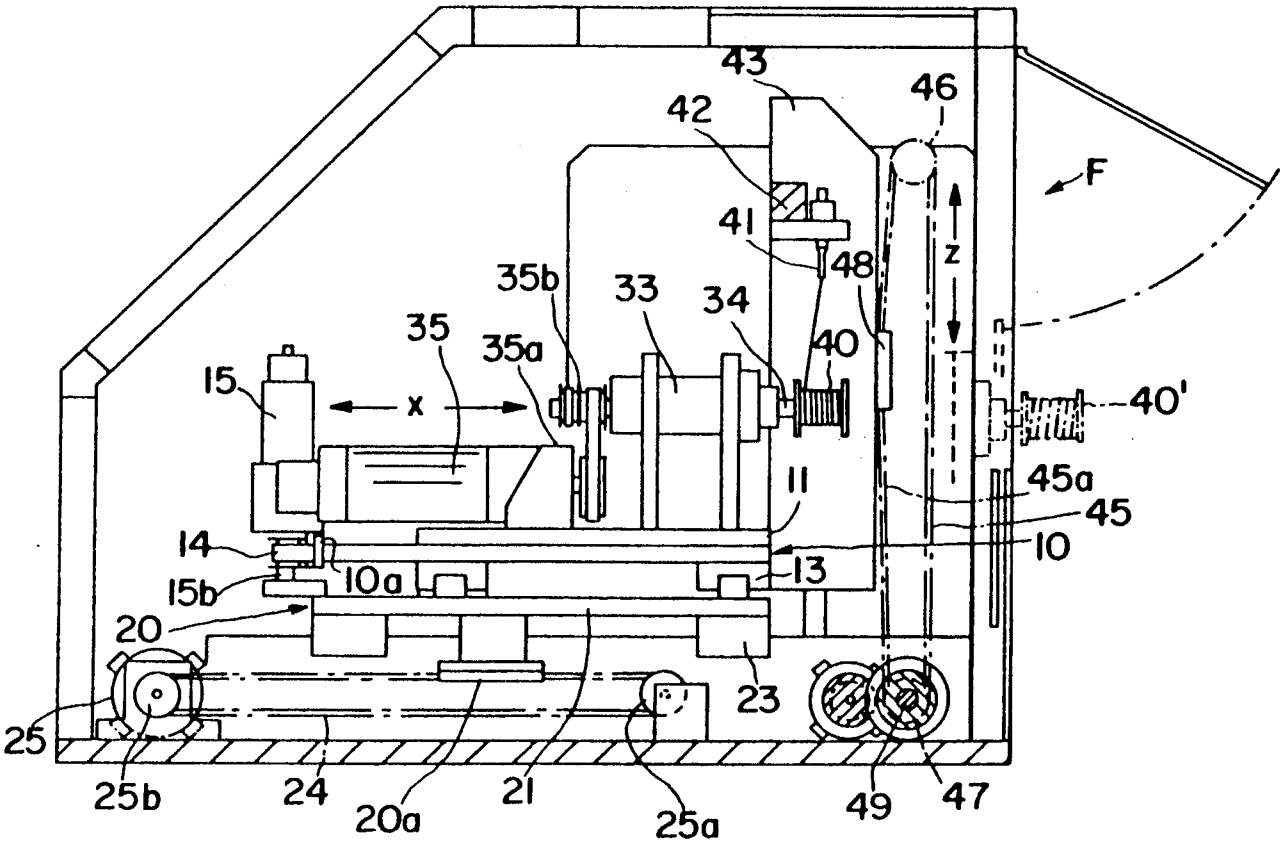
FIG. 1 is a diagrammatic lateral view of a coil winding machine according to the present invention.
Figure 2:
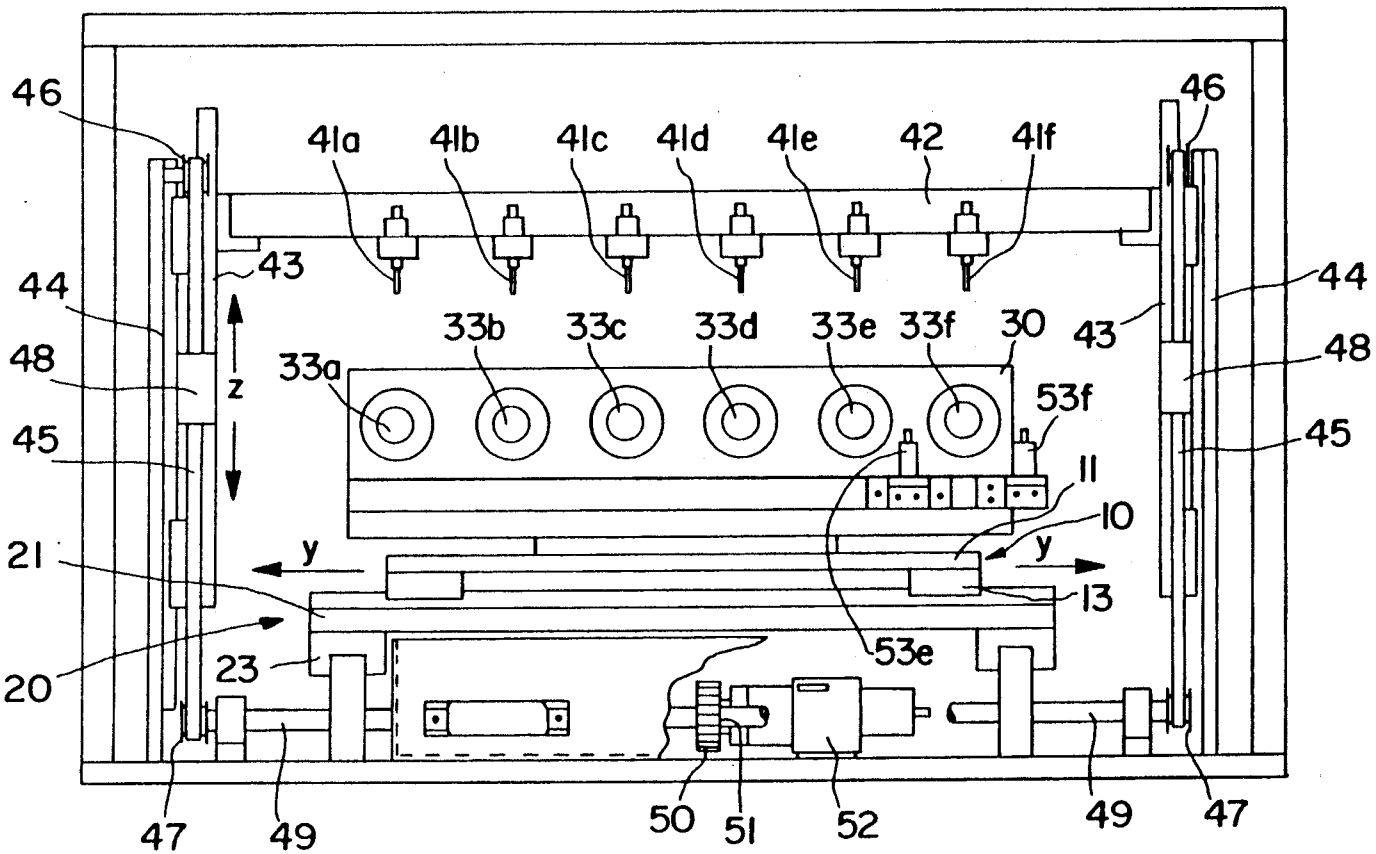
FIG. 2 is a diagrammatic front view of the machine shown in FIG. 1.

As clearly shown in FIGS. 1 and 2, the coil winder according to the invention has a structure formed of the following main elements:

- a first slide unit 10, the baseplate 11 of which supports the head 30 of the group of spindles 33. The slide 13 of this slide unit is movable along the axis Y and is moved by a respective motor 15 in the way better described hereinafter;
- a second slide unit 20, the baseplate 21 of which carries the guides for the slide 13 of the unit 10. The slide 23 of this slide unit 20 is movable along the axis X and is moved by a respective motor 25, also through means better described hereinafter;
- a head 30 to support the spindles 33, which are aligned along the axis and are caused to rotate by a motor 35; as shown in FIG. 2, this head 30 supports a group of six spindles 33*a* to 33*f*, all parallel to the axis X and rotated by the motor 35 through a belt and chain drive 35*a*-35*b* (not illustrated in further detail as being of known structure).

Means 34, supporting a respective coil 40 to be wound, are fixed onto each of the spindles 33 on the side facing the front F of the machine. These means can consist for example of a square pin or of a gripper of general use; since such means are anyhow of known type, they have not been illustrated herein in detail.

Flyers 41*a* to 41*f*, mounted onto a common stiff bar 42, are provided in correspondence of and above each of the spindles 33*a* to 33*f*. The bar 42 is fixed by its ends on two slides 43, sliding along two respective fixed vertical guides 44. The motion of the flyers 41 thus takes place along the vertical axis Z.

The movement of the slides 43 is obtained by means of two toothed endless belts 45, or like, mounted rotating on corresponding toothed pulleys 46, 47. For this purpose, one of the branches of the belt 45, and precisely the branch 45*a* closest to the slide 43, is fixed onto the slide by means of an anchor plate 48; the plate is preferably provided with a toothing which directly engages with the toothing of the belt 45. With reference to FIG. 1, it can be seen how the slide 43 is fixed onto the left branch of the belt 45 and thus moves upward along the guide 44 when the pair of pulleys 46, 47 performs a clockwise rotation.

Out of the two pairs of pulleys 46, 47, about which circulate the two belts 45 at the two sides of the machine, only the pulleys 47 are motor-driven. The two pulleys 47 are in fact connected by a common driving shaft 49 which is caused to rotate, through a pair of gears 50-51, by a motor 52.

This system to move the slides 43—by way of a motor-driven belt, a branch of which is fixed to the slide—is also adopted for moving the slide units 10 and 20. As shown in FIG. 1, the unit 20 is moved by the belt 24 which slides on pulleys 25*a* and 25*b*, this latter being keyed onto the shaft of the motor 25; the upper branch of the belt 24 is anchored to the slide unit 20 by means of the anchor plate 20*a*. Likewise, the unit 10 is moved by the motor 15 through a pair of pulleys 15*a*, 15*b* (of which only the pulley 15*b* can be seen in FIG. 1) onto which slides the belt 14, one branch of the belt being anchored to the slide unit 10 by means of the plate 10*a*.

A system of this type has been found particularly simple, efficient and long lasting, as well as economical. It is however possible to adopt more traditional motion systems, as screw-and-nut systems, with the screw keyed onto the shaft of the respective driving motor and with the nut fixed onto the slide unit.

From the above description it appears quite evident how the structure of the coil winder according to the present invention allows:

- to impart to the coil 40 a rotary winding motion around the axis X—normally required for coil winders of this type—by means of the motor 35;
- to moreover perform relative movements between the coil 40 and the flyers 41, along the three cartesian axes X, Y, Z (so as to not only distribute the wire turns around the coil, but also twist the wire ends on the coil terminals), by imparting to the flyers 41—according to the fundamental concept of the invention and in a substantially different way from prior art—only the movement along the axis Z, performed through the slides 43 and controlled by the motor 52, while the movements along the axes X and Y are imparted to the spindles, or rather to the spindle-head 30, and are performed through the slide units 20 and 10 respectively, and controlled by the respective motors 25 and 15.

Anchor pins 53*a* to 53*f* are provided on the front part of the spindlehead 30 (only pins 53*e* and 53*f* are depicted), at the side of each spindle 33*a* to 33*f*; each pin is mounted into a respective cylindrical seat and is movable between a working position, in which it projects outwardly of its seat, and a discharging position, in which it is withdrawn into its seat. The pins are provided—in known manner—for the temporary anchorage of the wire ends while the coil is being replaced.

In fact, once a coil has been wound and the twisting of the wire end onto a coil terminal has been completed, the wire is guided up to a respective anchor pin, whereon it is anchored usually by simply twisting some turns thereof: wire cutting can then be performed along its stretch between said coil terminal and the anchor pin, so as to release the coil while keeping the wire end anchored in a safe position.

The finished coil is then moved into the position 40', is unloaded from the respective spindle and is replaced by an empty coil core; the spindlehead 30 is then moved backward, carrying the empty coil cores to the winding position 40. In this position, the wire—still anchored on the respective pin—is first of all carried back next to the first coil terminal, so as to be twisted thereon, and is finally cut along its stretch between said terminal and the anchor pin; while the coil is rotated to carry out the winding, the short wire length, twisted by a few turns around the anchor pin, can be discharged by withdrawing the pin into its cylindrical seat.

Figure 3:
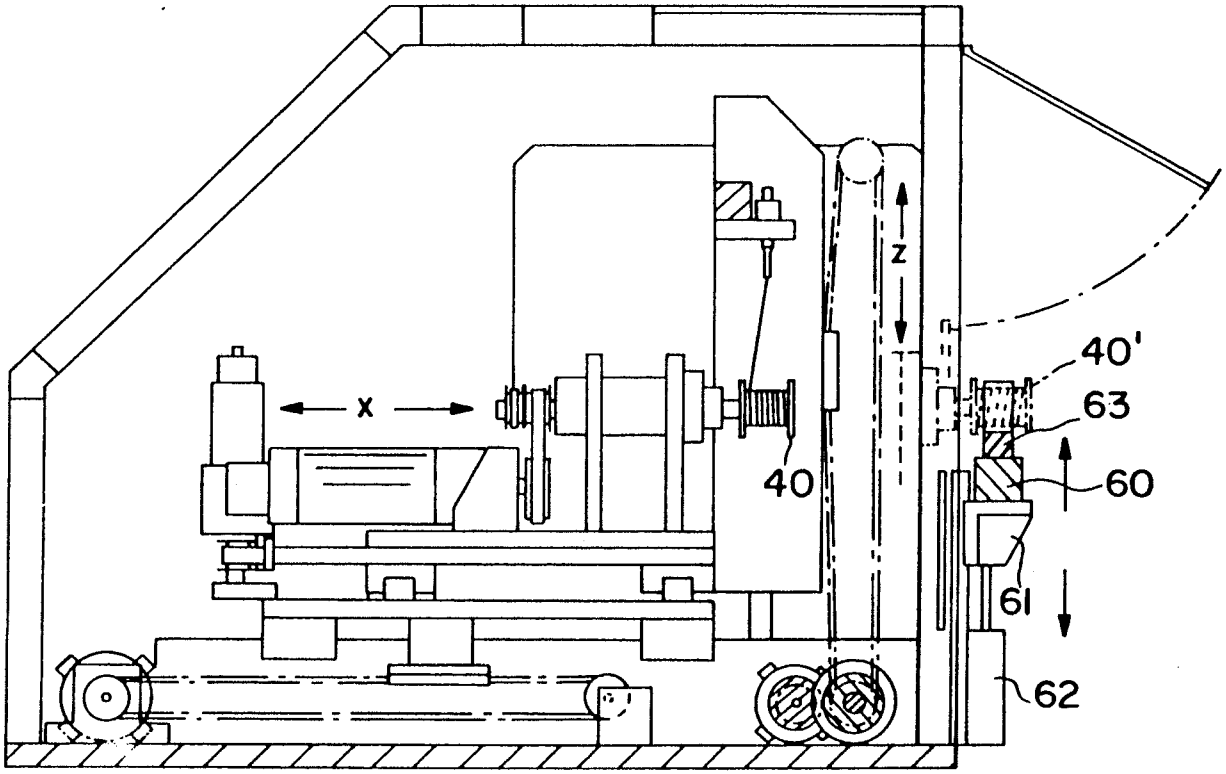
FIGS. 3 and 4 are views similar to that of FIG. 1 showing, respectively, two different embodiments of the coil winder.
Figure 4:
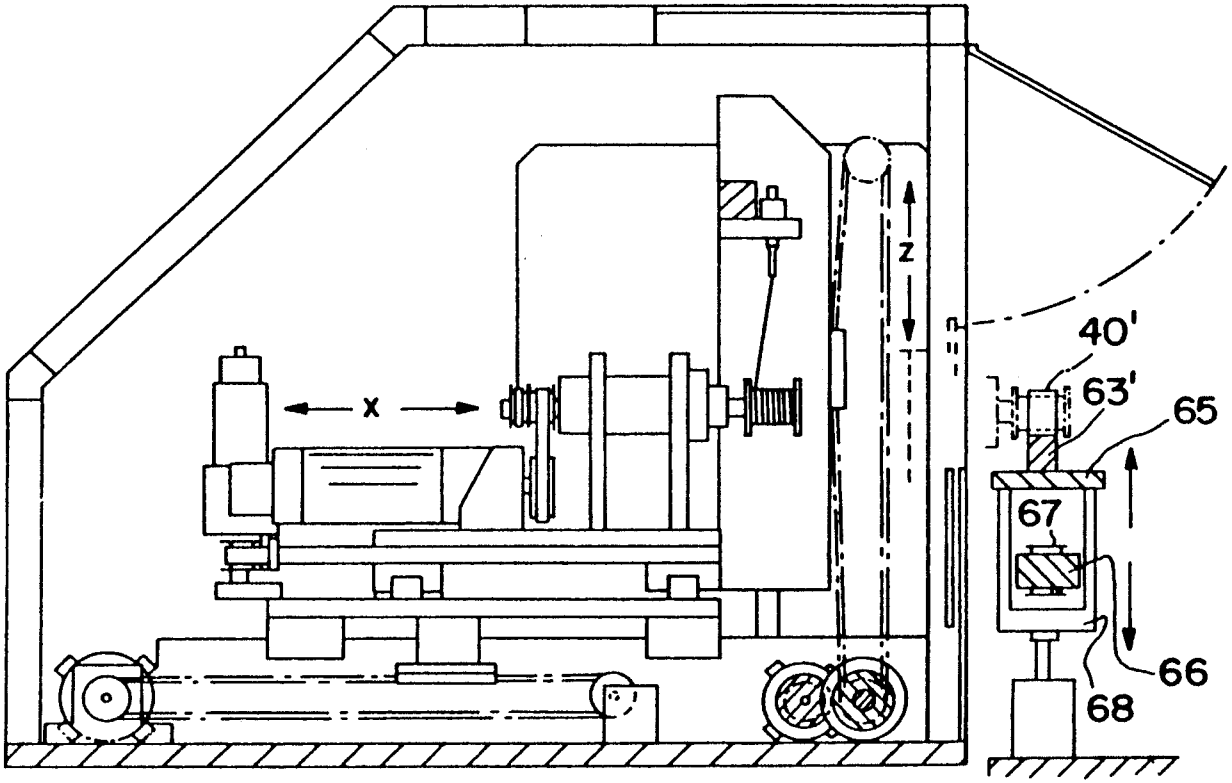
Figure 5:
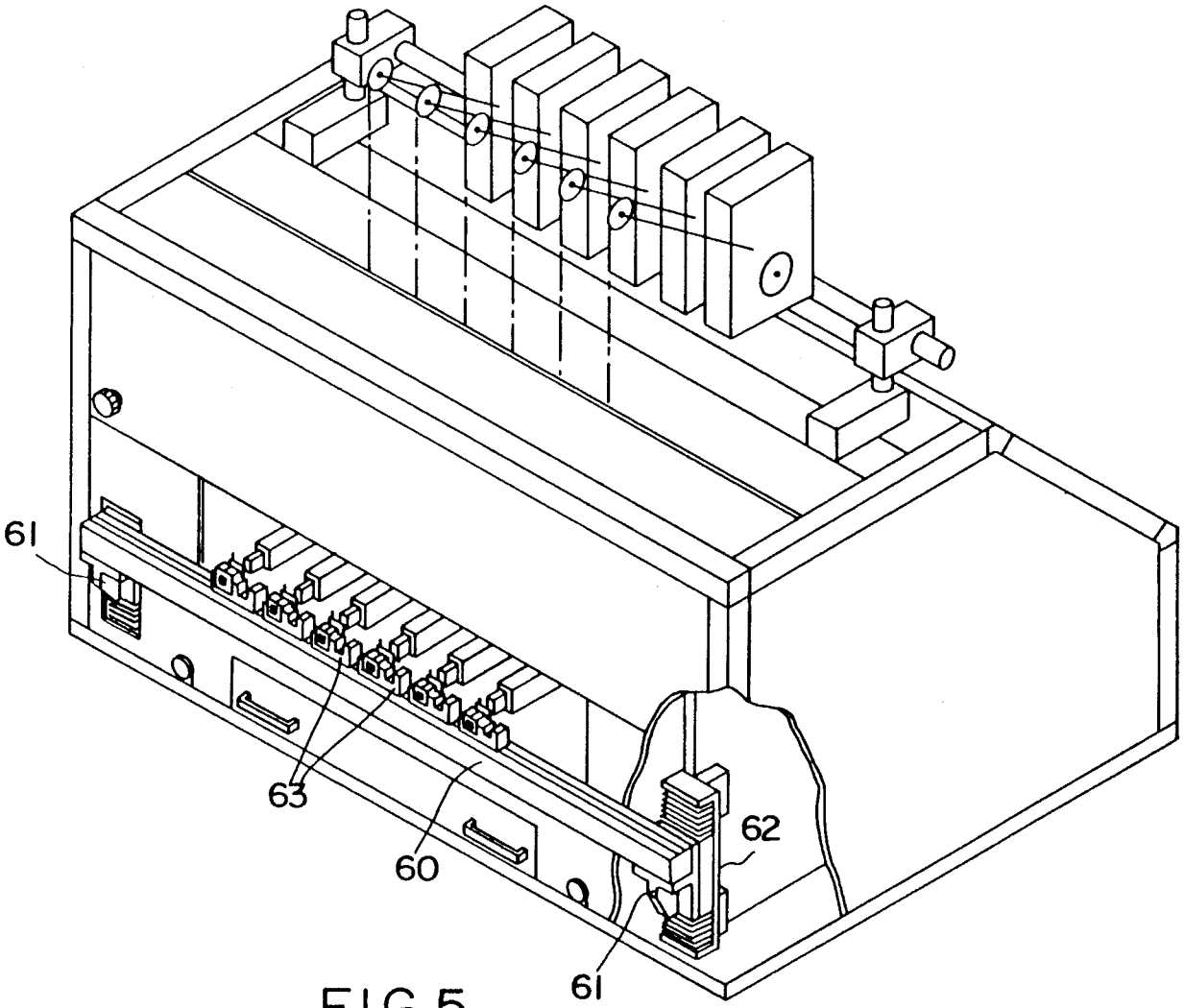
FIG. 5 is a diagrammatic perspective view of the coil winder according to the embodiment of FIG. 3.

The main considerable advantage of this machine structure lies in the fact that, as already pointed out, once a coil 40 is finished—that is, after having carried out both the winding of the wire (obtained by controlling the rotation of the spindles 33 about the axis X and the movement of the slide 23, i.e. of the actual spindles 33, along the axis X) and the twisting of the wire end on the coil terminals (obtained by controlling the movements along the three axes X, Y and Z)—it is possible to move the whole unit 30 along the axis X, by means of the slide unit 20, so as to carry the finished coil 40 out of the machine, that is beyond its front part F, for instance into the position 40' shown in dashed lines in FIG. 1. The result is that, in this position:

- the coil 40 can be unloaded and replaced by an empty coil core—with the help of an operator—in a substantially known manner, which is a more immediate and rapid operation than in machines of known technique;
- the coil 40 can be unloaded and replaced by means of an automatic loading and unloading device which—as shown in the embodiment of FIGS. 3 and 5, described hereinafter—can have an extremely simplified and economical structure;
- the coil 40 can be loaded and unloaded from a pallet of an automatic production line—as shown in FIG. 4—without requiring any further handling means.

FIGS. 3 and 5 show how the coil winder according to the present invention can work in combination with a loading and unloading device, merely consisting of a support bar 60 adapted to simply move up and down into fixed positions. The ends of the bar 60 are mounted on two brackets 61, each of which is carried by a vertically movable piston unit 62.

When the coil winder is winding up the coils, the bar 60 is in a lowered position and the operator can load the empty coil cores onto a series of double-seat supports 63, provided on the bar. At the end of the winding operation, the spindlehead 30 is moved—the movements being imparted along axes X and Y—to carry the coils into the position 40'; the bar 60 is then moved up into the working position (shown in FIGS. 3 and 5) until the coils 40' are housed into the empty seat of each support 63; the spindlehead 30 is then moved backward (along the axis X) to withdraw the spindles from the cores of the wound up coils; the spindlehead 30 is subsequently moved to the side (along Y) and again forward (along X) to carry the spindles into the empty coil cores housed into the other seat of each support 63; finally, the bar 60 is moved down, on the one hand, to release the empty coil cores onto the spindles and thus allow a new winding operation to start and, on the other hand, to carry the wound up coils into the unloading position.

The above clearly shows the great advantage of the machine according to the invention, which—by simply transferring the control of the motion along axes X and Y to the spindles (instead of the flyers, as in known technique)—allows to simplify the automatic loading and unloading device: in fact, as already mentioned, this can be provided to perform a simple movement along the axis Z, with only two fixed positions. A movement of this type can thus be realized at a cost equal to only 20% the cost of a known loading and unloading device, moving along two axes. On the other hand, the cost of the coil winder remains practically unvaried since, transferring the control of the motion along axes X and Y from the flyers to the spindles, merely involves an adjustment in the sizing of the machine, which means—in practice—the sizing of the slide units (10, 20).

This fundamental advantage of the machine according to the invention—which, in the case of the embodiment of FIGS. 3 and 5, mainly lies in a considerable cost reduction—is even more apparent in the embodiment of FIG. 4, that is, in the case of using the machine according to the invention as a working station of an automatic production line. In this case, in fact, it is not so essential to contain costs as, above all, to considerably reduce the dimensions of the loading and unloading system, so that it may interfere only to a minimum extent with the actual production line.

This additional advantage is evident from FIG. 4, in which pallets 65 are moved forward along a transport line—represented in FIG. 4 by the cross section of a longitudinal support member 66 and of a conveyor belt 67—each carrying coil support 63' (similar to the supports 63 in FIG. 5), in a fully known manner. When a series of pallets 65 is stopped in front of the finished coil positions 40', the pallets are lifted—and the supports 63' are lifted therewith—by means of a piston lifting unit 68, fully similar to the unit 60-61-62 shown in FIG. 5. The unloading of the wound coils and the loading of the empty coil cores then takes place in the same manner as described heretofore in connection with the embodiment shown in FIGS. 3 and 5.

I claim:

1. A coil winder comprising a plurality of rotary spindles each adapted to support a coil core, said spindles being rotatable about axes which are parallel to each other, a single support head supporting said plurality of spindles, a flyer for each said spindle, means for moving said support head relative to said flyers in each of two horizontal directions perpendicular to each other, said support head being carried by a first slide movable along one said horizontal direction and said first slide is mounted on a second slide movable along the other said horizontal direction perpendicular to the first said horizontal direction, and means for moving said slides selectively in said horizontal directions.

2. A coil winder as claimed in claim 1, and means for moving said flyers only along a vertical axis relative to said support head.

3. A coil winder as claimed in claim 2, in which all said flyers are mounted on a common bar for conjoint movement only in a vertical direction.

* * * * *